US005235926A

United States Patent [19]

Jones

[11] Patent Number: 5,235,926

[45] Date of Patent: Aug. 17, 1993

[54] ANTI-SKID DEVICE FOR FLAT-BOTTOMED BOATS

[76] Inventor: Earl R. Jones, P.O. Box 400, Cedar Hill, Mo. 63016

[21] Appl. No.: 894,109

[22] Filed: Jun. 5, 1992

[51] Int. Cl.[5] ..... B63B 39/06

[52] U.S. Cl. ..... 114/126; 114/141; 114/152; 114/63

[58] Field of Search ..... 114/121, 126, 127, 128, 114/129, 130, 131, 140, 141, 152, 145 A, 144 R, 274, 278, 63

[56] References Cited

U.S. PATENT DOCUMENTS

| | | | |
|---|---|---|---|
| 2,998,791 | 9/1961 | Light | 114/66.55 |
| 3,093,105 | 6/1963 | Rebikoff | 114/126 |
| 3,516,100 | 6/1970 | Ellis | 114/141 |
| 3,982,493 | 9/1976 | Cronin | 114/152 |
| 4,437,841 | 3/1984 | Stallman | 440/42 |
| 4,439,166 | 3/1984 | Maxwell | 114/141 |
| 4,569,302 | 2/1986 | Gruzling | 114/129 |
| 4,776,294 | 10/1988 | Childs | 114/126 |
| 4,779,553 | 10/1988 | Wildhaber | 114/144 R |
| 4,807,553 | 2/1989 | Brown | 114/152 |
| 5,127,353 | 7/1992 | Wieser | 114/145 A |

*Primary Examiner*—Joseph F. Peters, Jr.
*Assistant Examiner*—Stephen P. Avila

[57] ABSTRACT

A pair of pivotally attached fins depend into the water below the hull of the boat. When turning maneuvers are executed the tendency of the boat to skid sideward is resisted by the downwardly engaged fin panels. The device provides improved steering control to all boats so equipped, but especially to outboard jet powered boats traveling in shallow water. When underwater objects or the bottom of a body of water are encountered, the leading edge of the fins strike the object(s), causing the fins to pivot upward to clear the obstacle(s) and then return automatically to the water to provide an extra measure of boating safety.

1 Claim, 1 Drawing Sheet

ANTI-SKID DEVICE FOR FLAT-BOTTOMED BOATS

BACKGROUND—FIELD OF INVENTION

This invention relates to an anti-skid device for improving the steering capabilities of flat or nearly flat bottomed boats in general and in particular to outboard jet powered boats as they plane along the surface of the water.

BACKGROUND—DESCRIPTION OF PRIOR ART

There has long been a need to reduce side slippage of boats as they execute turning maneuvers while in a planing attitude. Although flat-bottomed boats equipped with conventional outboard engines do have a tendency to slide in turns, it is to a lesser extent and attention here will be focused on the outboard jet equipped boat.

Today's larger populations and their quest for outdoor recreation has led an ever increasing number of people to begin using outboard jet powered boats. These boats enable enthusiasts to travel in the more inaccessible and shallow portions of rivers, lakes, or other bodies of water. These bodies of water are often narrow and rock, or log filled, as well as shallow. Frequently boats are called upon to negotiate turns while planing along the surface in such places. Conventional outboard powered boats have less difficulty maneuvering because they have the engine's propped lower unit to act as a rudder and also to provide surface area to reduce side slippage in turns. However, because this lower unit depends well into the water below the boat's hull, it cannot operate safely in shallow or obstruction filled water.

Outboard jet powered boats can operate in very shallow water as little as 2–4 inches (5–10 cm.) over underwater objects such as rocks, logs, or the actual bottom of a body of water. This ability, however, is not without its limitations.

Necessarily the boat upon which an outboard jet is installed must have a flat, or nearly flat bottom to allow for this shallow running capability. Forward propulsion is created by the thrust of the jet race and straight line travel is accomplished with little difficulty but a problem arises when turning maneuvers must be executed. An outboard jet engine steers the boat by pivoting on it's axis; thus directing its jet race either to the left or to the right. Because flat bottomed boats have very little water displacement at planing speeds and there is no keel, rudder, skeg, or other device depending downward from either the boat hull or the engine to reduce lateral movement in turns, the natural elements of centrifugal force combine with the now sideward thrust of the maneuverable jet race to tend to force the boat hull to skid and steering control is reduced. Unfortunately, many boat operators lose control of their watercraft in such situations and often run aground or strike objects in their now misdirected path, causing property damage or personal injury.

Steering control problems of outboard jet powered boats have been addressed by prior art inventors. In U.S. Pat. No. 4,779,553 to Wildhaber on Oct. 2, 1987, an automatic rudder was employed but attention was focused on boats operated in reverse and at low or drifting forward boat speeds. In general, property damage or personal injury are of little concern in such situations. In U.S. Pat. No. 4,437,841 to Stallman on Nov. 4, 1981, the steering control problems at higher planing speeds were addressed. A modified boat hull formed a channel to direct water into the outboard jet. This may have allowed the boat to maintain power in turns but lateral slide may still have been a problem because there is simply no underwater device employed to stop it.

The invention described herein is a transom mounted unit with a pair of pivotally attached, longitudinally parallel fins depending into the water below the boat hull. It provides resistance to the tendency of the boat hull to skid sideward when turning maneuvers are performed at higher, planing speeds.

The anti-skid device may be constructed of a rigid material such as sheet aluminum or steel. The base assembly component parts are assembled by welding or other suitable means and bolted or otherwise secured to the boat transom. The fins are constructed of the same rigid metal and are attached to the base assembly in a manner to provide for independent pivoting ability. The fins are housed in the base assembly in a gap between gussets which are integral to base construction and provide bilateral support for each fin, as well as pivotal connection. Incorporated in the design of each fin are features which control the limits of both upward and downward pivoting characteristics, and a convex leading edge which facilitates upward swing when objects are encountered. Additionally, each fin is supplied with a drag wing attached at an angle to urge the fin downward to counteract frictional upswing created by forward boat speed. When the boat is moving slowly or drifting, the fins fall by gravity and their own weight to their downward engaged positions and provide some resistance to lateral boat movement.

The object of this invention is to provide a device for reducing side slippage of flat-bottomed boats as they execute turns while planing along the surface of the water, thereby improving steering control.

It is another object of this invention to provide a device with pivotally attached fins depending below the boat hull that are independently and automatically retractable upon striking any underwater object or the actual bottom of a lake, river, or other body of water.

It is another object of this invention to provide a device with pivotally attached fins depending below the boat hull that are independently and instantly returned to their engaged positions once the object(s) are passed over.

It is another object of this invention to provide a device with fins containing elevational outline design features which limit upward and downward range of pivot.

In accordance with the immediately preceding object, it is another object to provide fins with convex leading edges to facilitate upward sweep when objects are encountered.

It is another object of this invention that by merely remaining in their downwardly engaged positions while the boat is not underway or is moving slowly, the fins provide some resistance to lateral movement when wind or current affect boat orientation.

It is another object of this invention to provide a device with pivotally attached fins that may be fixed in a non operative position whereby all effect on boat performance is nullified.

It is a final object of this invention to provide a device with pivotally attached fins that will improve steering control of flat-bottomed boats, is completely automatic and simple in operation, may be constructed and assembled easily by conventional methods, of a low-cost material such as aluminum, is durable, trouble free, and requires no maintenance.

These and other objects and advantages of the invention will become apparent from the following description and the accompanying drawings.

DETAILED DESCRIPTION OF THE DRAWINGS

Figure 1:
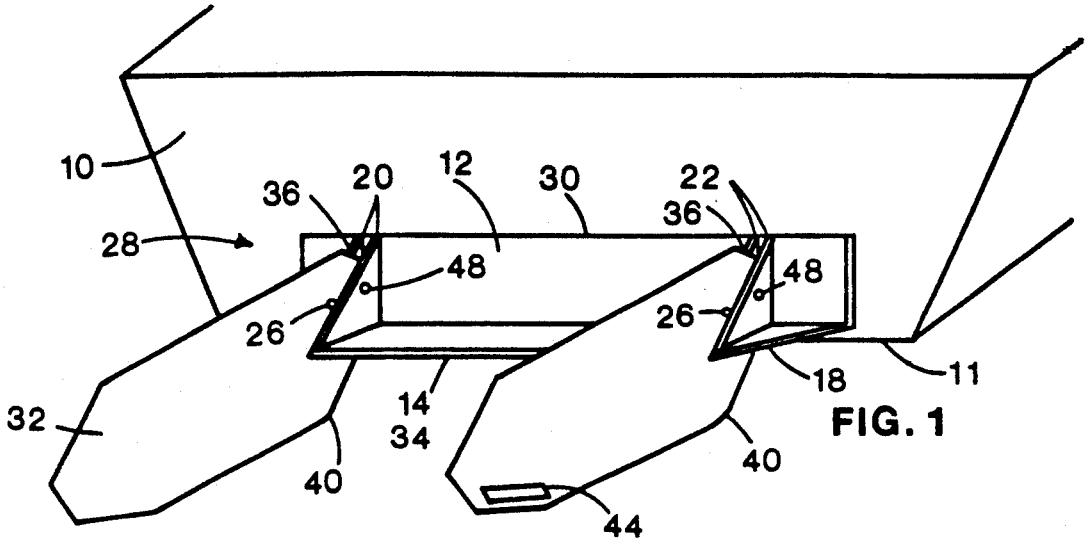
FIG. 1 is an isometric view of the anti-skid device of the present invention looking down from above and right of the stern toward the bow of the boat.

With reference to the drawings, in FIG. 1, the numeral 10 is used to designate in general the stern or transom area of a boat. It is shown here to represent the general placement of the anti-skid device on the transom of a flat-bottomed boat, but it should be understood that the shape and type of boat hull 11 may vary and so accordingly will the general placement of the device.

Figure 2:
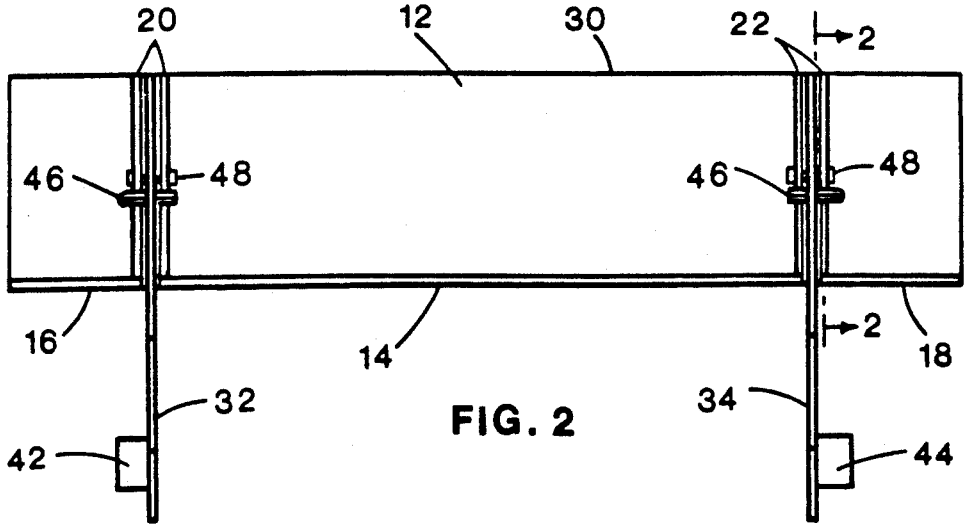
FIG. 2 is a diagram of the anti-skid device of the present invention taken from a rear elevational view.
Figure 3:
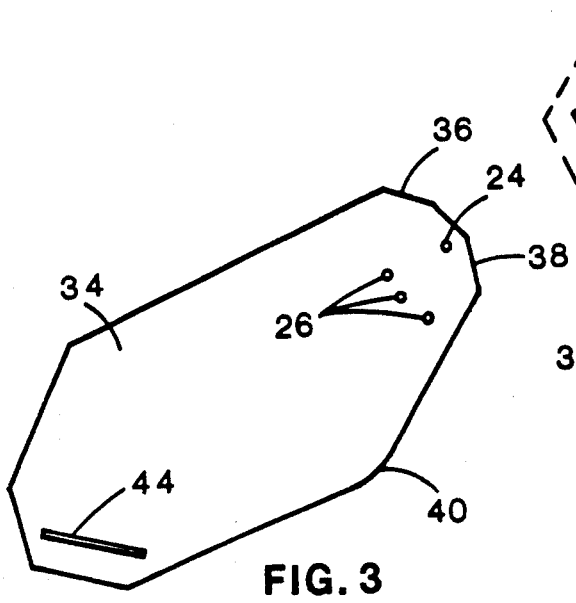
FIG. 3 is a right side elevational view of the right side fin of the present invention.
Figure 4:
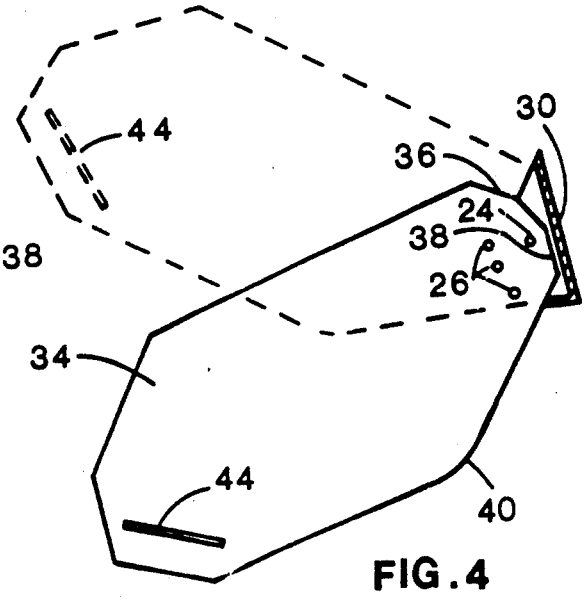
FIG. 4 is a right side elevational view of the present invention taken in cross section along lines 2—2 of FIG. 2 showing the right side fin housed in the base assembly in its downwardly engaged limit of pivot and in dotted lines in its upward or disengaged limit of pivot.

The anti-skid device of this invention is indicated in general by the reference numeral 28 in FIG. 1. It is comprised of three separate pieces: the left fin 32, the right fin 34, and the base assembly 30. As seen in FIGS. 1 and 2 the base assembly 30, which is constructed of rigid sheet aluminum components, consists of a transom plate 12, a base plate 14, a left corner base plate 16, a right corner base plate 18, a pair of left gussets 20, and a pair of right gussets 22. The rectangular transom plate 12 is joined at its bottom edge with the triangular base corner plates 16 and 18 at each end and the rectangular base plate 14 in the center. These are attached by welding to form an angle whereby the transom plate 12 lies flat on the boat transom 10 in FIG. 1, and the base plates 14, 16, and 18 generally parallel the longitudinal bottom line of the boat hull 11. Additionally, a gap is provided between corner base plate 16 and base plate 14 on the left side and base plate 14 and corner base plate 18 on the right side, as seen in FIG. 2. The gaps are enclosed on each side by gussets 20 and 22 as best seen in FIG. 1. The triangular gussets conform to the inside angle of the base assembly 30 and are welded in place providing the integral structure of the unit. The gussets 20 and 22 are spaced apart to provided a yoke for the pivotally attached fins, 32 and 34. The fins are edge upstanding panels constructed of rigid sheet aluminum with a thickness of approximately ⅛ inch and an elevational outline encompassing an area of substantially 85 square inches each. FIGS. 3 and 4 show the right side fin 34 in detail. A hole 24, is provided in the fin allowing for pivotal attachment by means of bolt 48 FIG. 2, installed in holes (not shown) in the base assembly 30. The fin 34 in FIGS. 3 and 4 has edges 36 and 38 to provide for limits to the range of pivot and a convex leading edge 40. In FIG. 2, the fins 32 and 34 are provided with drag wings 42 and 44 which are perpendicularly attached by welding at a downward angle as seen in FIG. 3, numeral 44. Additionally, the fins 32 and 34 are provided with holes 26 as seen in FIGS. 3 and 4 of the right side fin 34. A pin 46, FIG. 2, may be installed in holes 26 to disengage the fins from their operative positions.

In operation it will be understood that a flat-bottomed boat may be propelled along the surface of the water in a planing attitude by any one of a variety of propulsion methods (not shown) common to the art.

The anti-skid device 28 in FIG. 1 is installed medially on boat transom 10, proximate the hull bottom 11, when the boat is at rest or moving slowly, the pivotally attached fins 32 and 34 fall by their own weight and the action of gravity to their downwardly engaged positions. In this position the fins, with their surface area disposed substantially below the hull bottom, provide some degree of resistance to lateral boat movement. As boat speed is increased the fins are urged to remain downwardly engaged by the presence of the angularly attached drag wings 42 and 44 in FIG. 2. The drag wings have a surface area of approximately 1.5 square inches and utilize water drag to overcome the tendency of the fins to be forced upward by friction with the water caused by forward boat speed. The boat performance is not noticeably affected by the minimal drag and as planing attitude is achieved, only the edge upstanding fins 32 and 34 remain in the water below the boat hull 11. As turning maneuvers are executed, the resulting centrifugal force tends to cause a flat-bottomed boat to skid sideward. The downwardly engaged fins 32 and 34, however, provide surface area sufficient to resist the lateral side, and steering control is improved.

When the boat is underway the downwardly engaged fins 32 and 34 depend below the boat hull 11 in FIG. 1. Should contact with underwater objects or the bottom of a body of water occur, the fins are pivotally attached by bolts 48, FIG. 2, to allow for freedom of movement. If the boat is moving slowly and objects are encountered the fins easily swing free and then fall by their own weight and the action of gravity back to their engaged positions once the objects(s) are passed. If the boat is traveling at a speed sufficient to cause the fins to be downwardly engaged by the action of the drag wings 42 and 44, the drag effect is overcome by the contact with an obstacle and the fins independently swing upward. Once the obstacle(s) are passed, the fins are instantly and independently returned to their downwardly engaged positions as the drag wings re-enter the water.

As best seen in FIG. 4, incorporated in the fin design are features that control the upward and downward limits of pivot. The downward limit of travel of fin 34 around pivot point 24 is obtained when edge 38 meets with the transom plate of the base assembly 30. When urged into this position by the drag wing 44, the fin provides its most efficient resistance to lateral slide. The upward limit of travel of fin 34 around pivot point 24 occurs when edge 36 meets with the transom plate of the base assembly 30 as shown in phantom in FIG. 4. This upward limit of pivot provides for protection against damage to the boat transom should upward travel of the fin have enough momentum to come into contact with an otherwise unprotected boat. Additionally, edge 40 FIG. 4, which is the leading edge and will make first contact with any underwater obstacle, is convex to facilitate upswing of the fin around its pivot point.

Should the boat operator choose to disengage the anti-skid device 28 FIG. 1 from operation, holes 26 in FIG. 4 are provided. A pin 46 FIG. 2, may be inserted into a selected hole and allowed to rest on gussets 20 and 22, thereby preventing fins 32 and 34 from entering the water.

Although the foregoing contains specificities of construction and operation it is not desired to limit the invention thereto. Many changes and modifications will become apparent to one skilled in the art. Such changes and modifications are within the scope of this invention as defined in the appended claims.

I claim:

1. An anti-skid device for flat-bottomed boats comprising: a base assembly for attachment to a transom of a boat hull providing lateral support and means of pivotal attachment for a pair of rigid, longitudinally parallel, edge upstanding fin panels; said fin panels being disposed substantially below a bottom line of said boat hull; said fin panels attached to pivot independently about a horizontal axis through gaps provided in said base assembly; said gaps being enclosed on each side by means of a pair of gussets; said gussets being provided with holes to accept means for pivotal attachment of said fin panels; said gussets providing means of lateral support for the rigid fin panels therein pivotally confined; said fin panels being provided at a forward portion with edges that make contact with said base assembly providing means for limiting the downward, water-engaging range of pivot; said fin panels being provided at a forward portion with edges that make contact with said base assembly providing means for limiting upward or disengaged range of pivot; said fin panels being provided with a drag wing attached substantially perpendicular to and at a downward angle for means of utilizing water drag to effect downward water-engaging positions; said drag wings having surface area sufficient to ensure downward engagement of said fin panels against frictional upswing created by forward boat speed; said drag wings having surface area sufficient to allow said fin panels to easily swing free around said pivot point as obstacles are encountered; said fin panels having a convex leading edge facilitating upswing around said pivot point when underwater obstacles are struck; whereby said pivotal fin panels provide means for resisting lateral slide of said boat when in their downward, water-engaging positions.

* * * * *